United States Patent [19]

McCabe

[11] 4,138,032

[45] Feb. 6, 1979

[54] FULL SECONDARY SEAL, WIPER TYPE, FOR A FLOATING ROOF TANK

[75] Inventor: John S. McCabe, Naperville, Ill.

[73] Assignee: Chicago Bridge & Iron Company, Oak Brook, Ill.

[21] Appl. No.: 836,577

[22] Filed: Sep. 26, 1977

[51] Int. Cl.[2] ..... B65D 87/207

[52] U.S. Cl. ..... 220/224; 277/152; 277/228

[58] Field of Search ..... 277/34, 34.3, 34.6, 277/138, 152, 153, 228, 233; 220/222, 224, 225

[56] References Cited

U.S. PATENT DOCUMENTS

| | | | |
|---|---|---|---|
| 1,698,158 | 1/1929 | Glass | 220/222 |
| 2,560,557 | 7/1951 | Curtis | 277/152 |
| 2,723,721 | 11/1955 | Corsette | 277/152 |
| 2,973,113 | 2/1961 | Fino | 220/224 |
| 3,167,206 | 1/1965 | Nelson | 220/224 |
| 3,204,809 | 9/1965 | Cadwell | 220/222 |
| 3,269,738 | 8/1966 | Baumler et al. | 277/81 |
| 3,372,831 | 3/1968 | Daniels et al. | 220/222 |
| 3,795,339 | 3/1974 | Barbier | 220/222 |
| 4,004,708 | 1/1977 | Boyd | 220/224 |

FOREIGN PATENT DOCUMENTS

| | | | |
|---|---|---|---|
| 161080 | 2/1955 | Australia | 277/153 |
| 198079 | 6/1958 | Australia | 277/152 |
| 1277238 | 10/1961 | France | 220/222 |
| 837814 | 6/1960 | United Kingdom | 277/95 |

*Primary Examiner*—Robert S. Ward, Jr.

*Attorney, Agent, or Firm*—Merriam, Marshall & Bicknell

[57] ABSTRACT

In a vertical cylindrical liquid storage tank having a circular floating roof, an improved sealing means including an elastomeric composite strip impermeable to vapor connected at its inner edge by an essentially vapor tight joint to the roof edge and extending as an annulus outwardly to the tank inner side wall, the elastomeric composite strip comprising a plurality of flexible resilient elongated stiffeners laterally positioned and embedded in elastomeric material, and the elongated stiffeners extending from the strip edge joined to the roof and terminating short of the strip edge at the tank wall.

An elastomeric composite strip, impermeable to petroleum vapor, having a plurality of flexible resilient elongated stiffeners laterally positioned and embedded in elastomeric material, with the elongated stiffeners extending from one strip edge and terminating about at the other strip edge.

11 Claims, 13 Drawing Figures

FULL SECONDARY SEAL, WIPER TYPE, FOR A FLOATING ROOF TANK

This invention relates to an improvement in floating roof tanks used for the storage of petroleum products or other volatile liquid materials, and in particular relates to an improved seal for a floating roof.

In a conventional floating roof tank, with which the seal of the invention is particularly useful, there is provided a clearance space or rim space between the tank side wall and the vertical rim of the roof. It is necessary to provide clearance space to permit unrestrained vertical travel of the roof within the tank. The clearance space is of sufficient size that local dimensional variations in the circularity of the tank sidewall or shell, commonly called out-of-roundness, which can result from uneven foundation settlement, imprecise fabrication or erection or unusual live loads such as high winds and the like, do not hamper vertical travel of the roof.

A conventional system for centering a floating roof in a tank and simultaneously sealing the space between the roof rim and the tank inner side wall employs as a sealing means a yieldable annulus suspended by the roof and extending from contact with the roof rim into contact with the tank wall. The annulus can be made of flexible sheet material and can contain a fluid, i.e. liquid or gas, such as water or nitrogen, or a resilient material such as a polymeric foamed material. U.S. Pat. Nos. 3,136,444; 3,120,320; 3,075,668; 3,055,533; 2,973,113 and 2,968,420 illustrate seals of those types.

Other apparatus to maintain the roof centered in the tank and to effect a seal against evaporation loss uses a plurality of vertical shoes adapted to slidably contact the entire circular inner side wall of the tank and means supported by the roof for pressing the shoes against the inner side wall, as well as to support the shoes. Vapor loss between the roof and shoes is prevented by a flexible nonpermeable fabric barrier which extends from the upper part of the shoes to the floating roof top edge. Such apparatus is disclosed in many U.S. Pat. Nos. including 2,587,508; 2,630,937; 2,649,985 and 2,696,930.

Although such types of seals function quite well in commercial installations some product vapor may still escape past the seal. This possibility is substantially increased on windy days since air flow over the floating roof creates a negative pressure over part of the circumference at the seal, and positive pressure over the other part. The positive wind pressure will usually be located in the semicircular rim clearance space downwind from the center of the roof and the negative pressure upwind. When the negative pressure is created the higher vapor pressure leads to flow of vapor, from beneath the sealing means, between the seal and the tank inner wall into the atmosphere. Similarly, the positive pressure causes air to flow into the vapor space, thereby setting up a flow around the vapor space and out the negative side carrying vapor with the flow. This results in undesirable air pollution. There is accordingly a need for improvements in such liquid storage tank floating roof seals and materials used in such seals.

Wiper type seals are also disclosed in the prior art and are used alone as a primary seal, or as a secondary seal in conjunction with a primary seal such as those already described. See U.S. Pat. Nos. 2,190,476; 1,698,158; 2,873,042; 2,973,113; and 3,372,831. U.S. Pat. No. 2,973,113 discloses a secondary wiper seal made of rubber with a reduced thickness hinge portion reinforced with embedded nylon. U.S. Pat. No. 2,190,476 discloses a primary seal in the form of a pear-shaped loop of sheet material with resilient metal strips embedded therein in spaced relation to each other. It is believed that such wiper seals will not produce the vapor seals now needed to prevent vapor emissions adequately to meet present day environmental air purity standards.

According to one aspect of the present invention there is provided, particularly for use in a floating roof annular clearance space seal, an elastomeric composite strip impermeable to petroleum vapor comprising a plurality of flexible resilient elongated stiffeners laterally positioned and embedded in elastomeric material, the elongated stiffeners extending from one strip edge and terminating about at the other strip edge, and about at least the outer two-thirds of said stiffeners having portions spaced-apart from adjoining stiffeners.

The elongated stiffeners can be flat or curved fingers of uniform thickness or tapered. The fingers can be tapered in width and narrower at the ends or they may be of about uniform width. In addition, the fingers can extend laterally from one side of a band positioned along one strip edge. The elongated stiffeners can be made of a polymeric material, such as sheet nylon or polypropylene, or from spring metal, such as spring steel or spring aluminum.

The elastomeric composite strip can be flat or preformed into a bent or arced shape before it is installed on the floating roof. The strip can be of uniform thickness, of varying thickness, i.e. tapered from one edge to the other or of stepped-down thickness.

According to a further aspect of the invention there is provided, in a vertical cylindrical liquid storage tank having a circular floating roof, an improved sealing means including an elastomeric composite strip impermeable to vapor connected at its inner edge by an essentially vapor tight joint to the roof edge and extending as an annulus outwardly to the tank inner side wall, the elastomeric composite strip comprising a plurality of flexible resilient elongated stiffeners laterally positioned and embedded in elastomeric material, the elongated stiffeners extending from the strip edge joined to the roof and terminating short of the strip edge at the tank wall, and about at least the outer two-thirds of said stiffeners having portions spaced-apart from adjoining stiffeners. The strip, and stiffeners used in the strip, may have the characteristics previously described above.

An important feature of the sealing means provided herewith is that it not only flexes in a vertical arc as the roof moves toward and away from any adjoining tank wall portion, but that circumferential stretching and contraction of the strip at its outside periphery is unrestrained by the stiffeners thereby permitting the strip to very readily and efficiently contact and accommodate to the contour and spacing of the tank wall from the roof edge.

The invention will be described further in conjunction with the attached drawings in which.

So far as is practical the same elements or parts which appear in the different views of the drawings will be identified by the same numbers.

Figure 1:
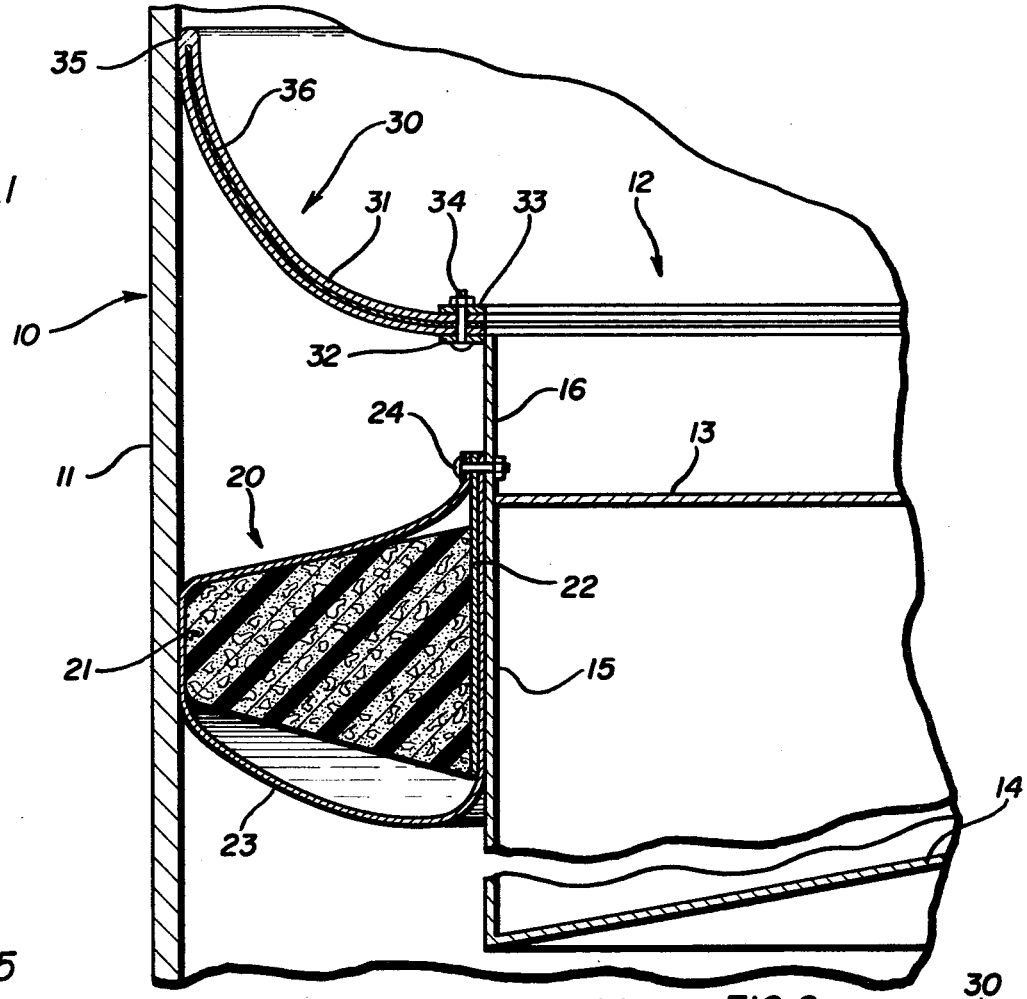
FIG. 1 is a vertical sectional view through a tank and the edge of a floating roof having a primary seal and a secondary seal.

With reference to FIG. 1, the tank 10 has a vertical circular cylindrical wall 11 in which floating roof 12 is located. The floating roof 12 has a top 13, bottom 14 and a vertical side 15 having an upper portion 16 which extends above top 13.

Mounted around the periphery of the floating roof are primary seal 20 and secondary seal 30. The primary seal 20 is of known construction and comprises a polymeric flexible and resilient foam annulus 21 bonded to a vertical circular metal plate 22. Vapor and liquid impervious fabric envelope 23 loosely surrounds the foam annulus 21. The ends of the fabric envelope 23 are brought together in contact with the top edge of metal plate 22 and fastened by bolts 24 to the upper portion 16 of the floating roof.

Figure 2:
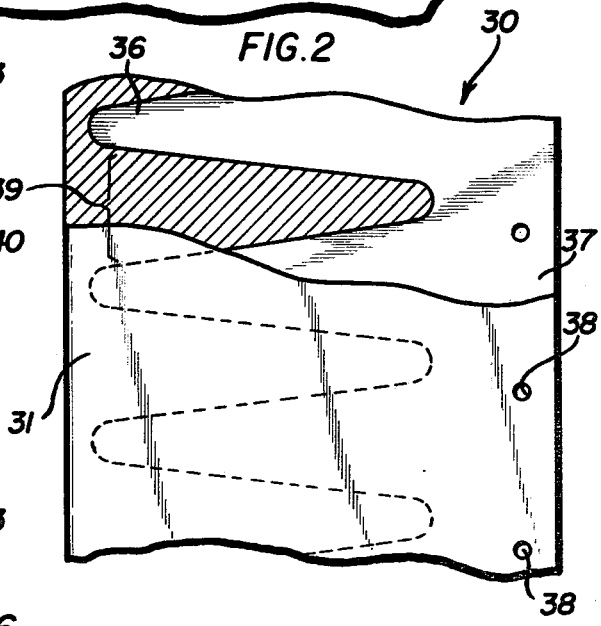
FIG. 2 is a plan view, partially in section, of the secondary seal of FIG. 1.
Figure 3:
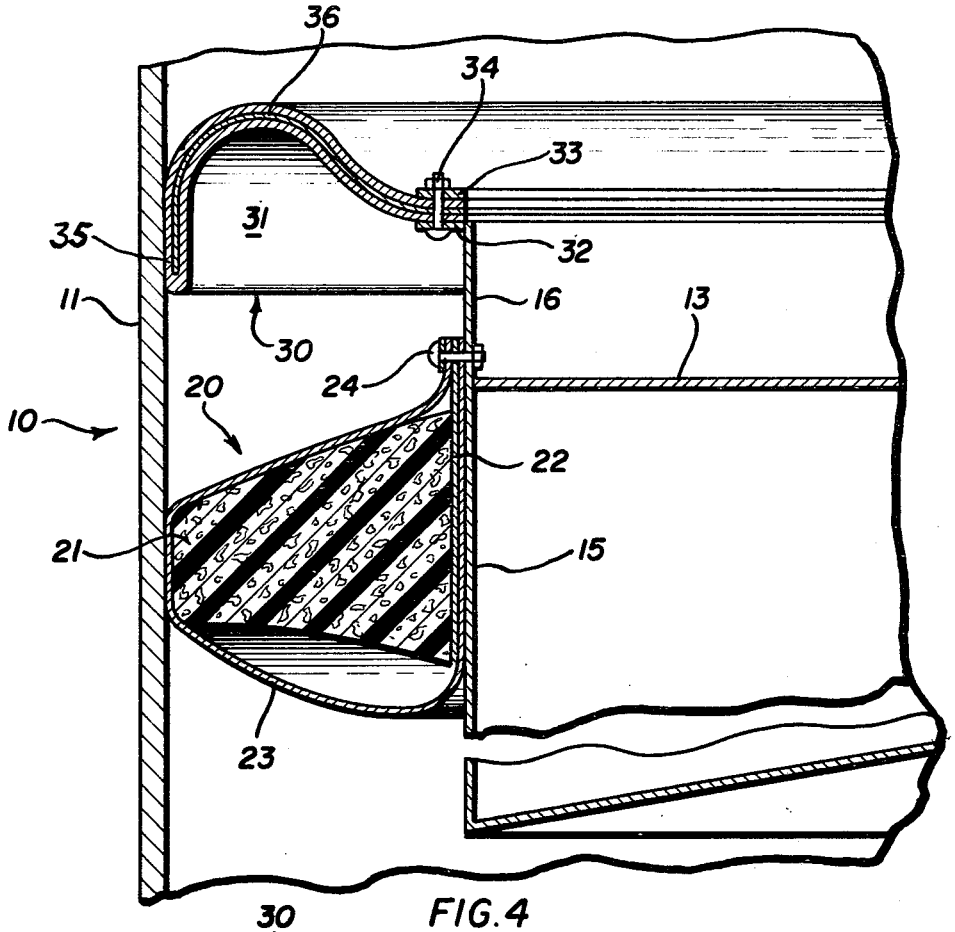
FIG. 3 is a vertical sectional view like FIG. 1 but with the secondary seal curved or bent first upwardly from the roof edge and then curved or bent downwardly.
Figure 4:
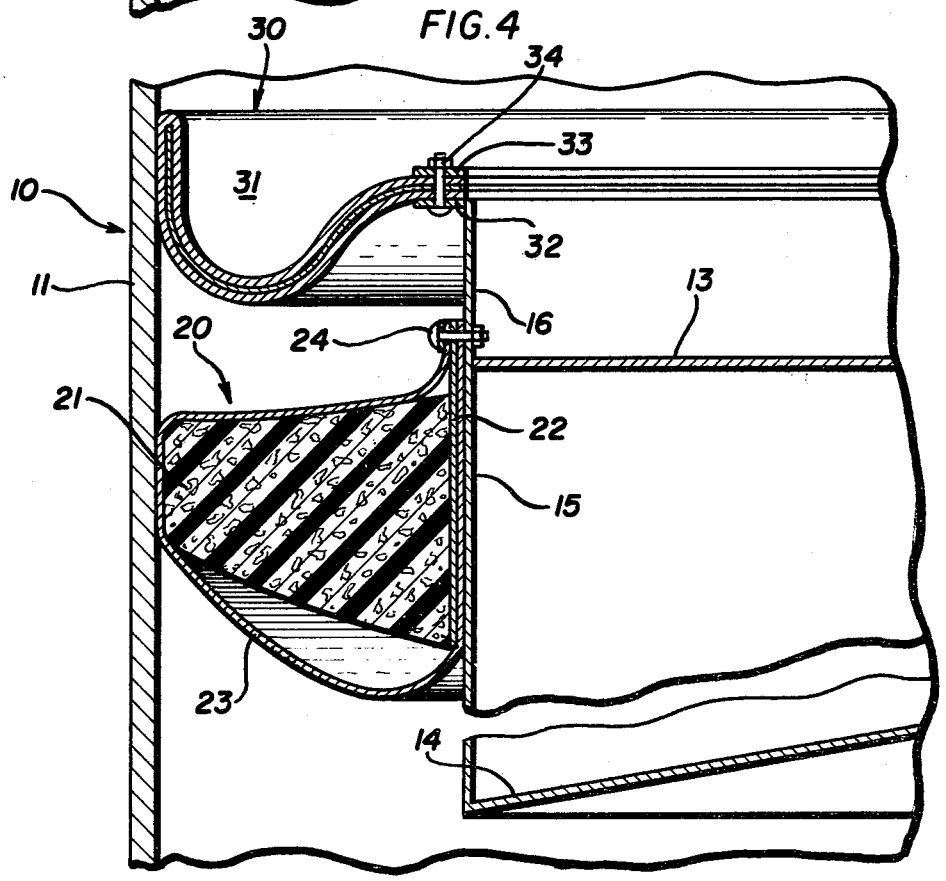
FIG. 4 is a vertical sectional view like FIG. 1 but with the secondary seal curved or bent first downwardly from the roof edge and then curved or bent upwardly.

To further guard against escape of vapor between the edge of the roof and the tank wall, the primary seal 20 is supplemented by secondary seal 30 which comprises elastomeric composite strip 31, impermeable to vapor, having its inner end connected to the roof edge flange 32 by metal band 33 and bolts 34. The composite strip 31, as shown in FIGS. 1 and 2, is normally flat, or preformed as in FIGS. 7, 8 and 9, but after installation on a floating roof it can acquire an upwardly (FIG. 1) or downwardly curved or bent shape since its width is always greater than the maximum distance between its place of connection to the floating roof and the tank wall, or a partially upwardly and partially downwardly curved or bent shape as shown in FIGS. 3 and 4. Due to its flexible, spring-like inherent properties, which continually seek to return it to its natural flat, or preformed, state in which it is manufactured, the outer peripheral edge 35 of the strip 31 is maintained in vapor sealing contact with the tank wall. As the floating roof moves up and down, as well as laterally due to wind action, the strip can be curved or bent from the simple arc shown in FIG. 1 to the double curved shapes shown in FIGS. 3 and 4, as well as other similar and related shapes.

The specific strip 31 as shown in FIG. 2 has a plurality of flexible resilient elongated stiffeners 36 laterally positioned and embedded in elastomeric material, which can be synthetic rubber, such as neoprene. The stiffeners may be roughened or otherwise prepared to improve bonding with the elastomeric material. The stiffeners 36 as shown in FIG. 2 are integrally joined to a band portion 37 along the strip edge. Spaced apart bolt holes 38 may extend entirely through strip 31 and receive bolts 34 when the strip is joined to the floating roof.

The stiffeners 36 as shown in FIG. 2 are flat fingers which are tapered and narrower at the edge of the strip 31 which contacts the tank wall than at the edge which is joined to the floating roof. This form of stiffener is particularly useful since the tapering fingers provide wide areas 39 of elastomeric material which provide excellent and necessary circumferential elasticity in strip 31 to maintain contact with the tank wall with increase in the radial space between the roof edge and the tank wall. Also, by using tapered stiffeners progressively greater stiffness of the total seal is achieved, i.e. it is stiffer at the roof rim and decreasingly stiff as it extends closer to the tank shell.

The flexible resilient elongated stiffeners can be made of metal, such as spring steel or spring aluminum, or they can be made of a solid polymeric sheet material having the necessary physical properties, such as nylon, polypropylene or even a glass fiber impregnated polymeric material as for example polymethacrylate.

Figure 5:
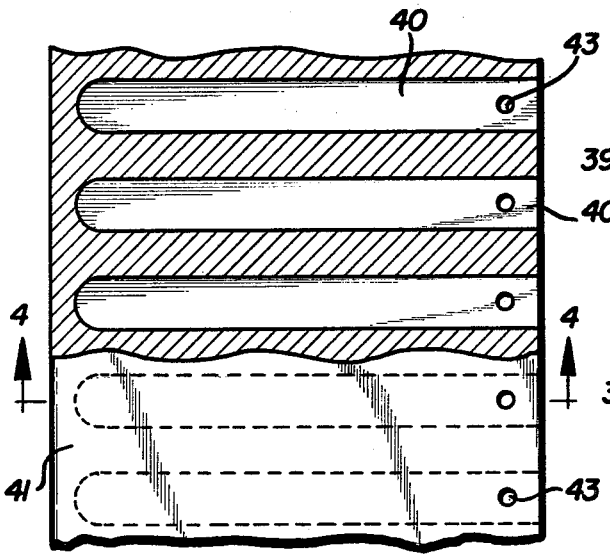
FIG. 5 is a plan view, partially in section, of a second embodiment of secondary seal.
Figure 6:
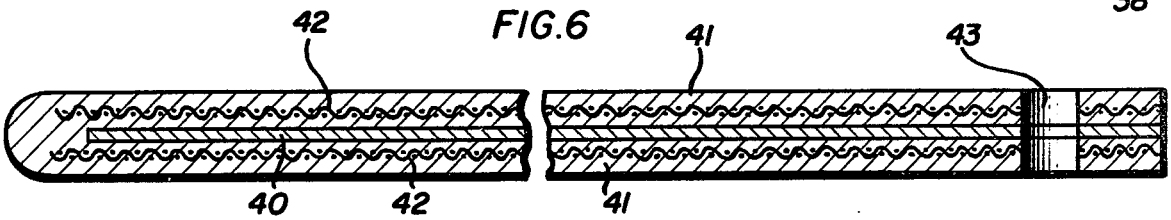
FIG. 6 is a sectional view taken along the line 4—4 of FIG. 5.

FIGS. 5 and 6 illustrate a second embodiment of the invention. In this embodiment a plurality of spaced apart separate flat rectangular stiffeners 40 are laterally positioned and embedded in elastomeric sheet material 41. A layer of woven fabric 42 is also embedded in the elastomeric material 41 on each side of the stiffeners 40. A series of bolt holes 43 may extend through the composite strip to facilitate joining it to the edge of a floating roof. This embodiment, like the first embodiment, should have at least the outer two-thirds of the stiffeners spaced apart from adjoining stiffeners to facilitate circumferential stretching of the strip to thereby maintain contact with the tank wall with variation in the radial distance between the roof edge and the tank wall.

Although the drawings illustrate the two embodiments of the invention used as secondary seals, it is intended that the strips and seals made therefrom also may be employed as the primary, or sole, seal.

The woven fabric 42 may also be employed in the first embodiment illustrated by FIGS. 1 and 2. A fabric layer can be placed on either the top or bottom side, or both sides, of the stiffeners. Alternatively, a plurality of cords can be embedded in the elastomeric material in place of a fabric.

In a specific form of the invention the embodiment of FIGS. 1 and 2 can be made of neoprene with stiffeners made of 0.06 in. nylon having 16 in. long fingers on 5 in. centers and with the band 3 in. wide along one edge of the strip.

FIGS. 7 to 13 illustrate seven embodiments of elastomeric composite strips which can be used as secondary seals according to the invention, or even as the sole or primary seal.

Figure 7:
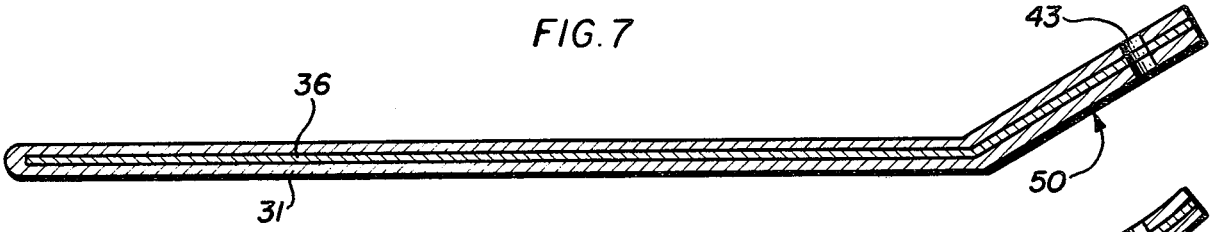
FIGS. 7 to 13 are sectional views of seven embodiments of elastomeric composite strips useful for forming secondary seals according to the invention.

The strip shown in FIG. 7 is like that shown in FIGS. 1 to 4 except that it is preformed to have an inclined or upwardly sloped end portion 50 which retains that form under normal circumstances. Such a strip may be manufactured flat with stiffeners 36 made of metal. It could subsequently be bent in a press-brake or between crimp rollers to the desired shape. Alternatively, the stiffeners 36 could be preformed into the bent shape shown in FIG. 7 and then covered with rubber or some other elastomeric material.

Figure 8:
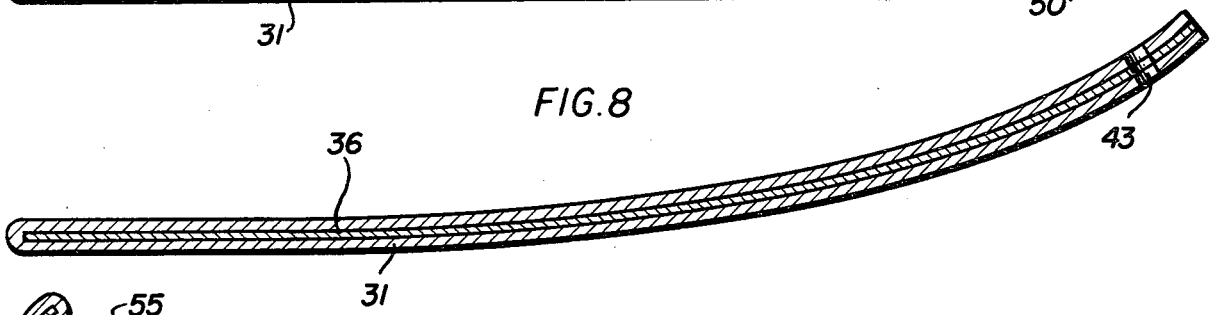
Figure 9:
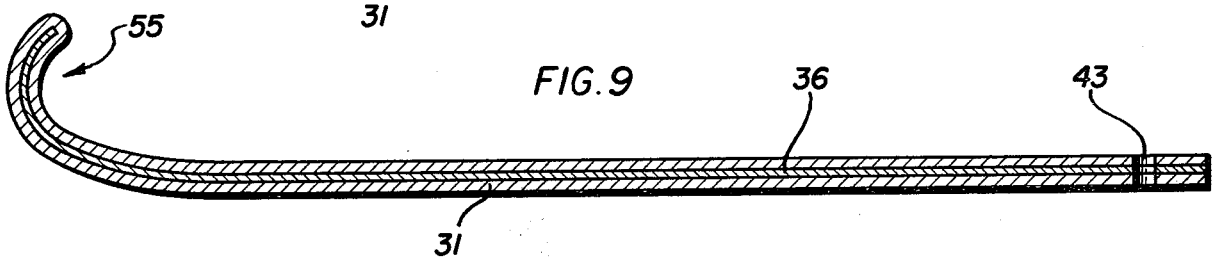

The embodiment shown in FIG. 8 constitutes an elastomeric composite strip like that shown in FIGS. 1 to 4 but preformed into an arcuate shape. Similarly, the embodiment of FIG. 9 has a preshaped arced end 55 but is otherwise flat like the strip shown in FIGS. 1 to 4 before it is installed on a tank roof.

Figure 10:
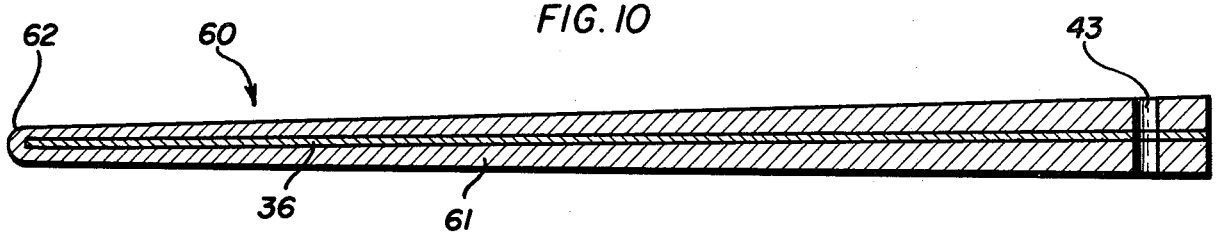

In the embodiment shown in FIG. 10 the strip 60 has stiffeners 36 as previously described and an elastomeric body 61 which is tapered in thickness so that the thick end is adjacent the bolt holes 43 and the thin end 62 contacts the tank inner wall surface. Tapering the strip is an additional way in which to control flexibility of the strip and the pressure with which it contacts the tank wall.

Figure 11:
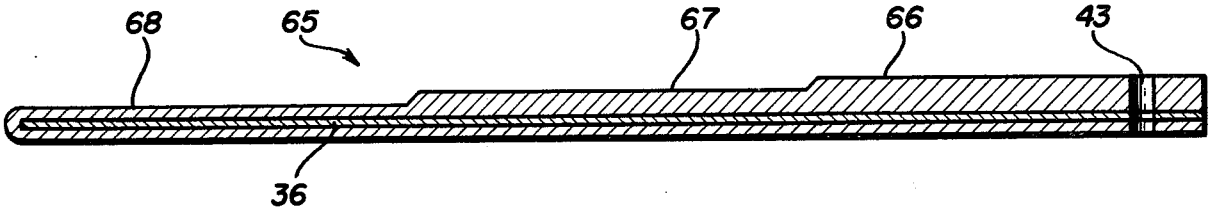

FIG. 11 illustrates an elastomeric composite strip 65 having stepped portions 66, 67 and 68 of decreasing thickness surrounding embedded stiffeners 36. By decreasing the thickness in steps the flexibility of the strip can be varied to obtain nearly any desired performance.

Figure 12:
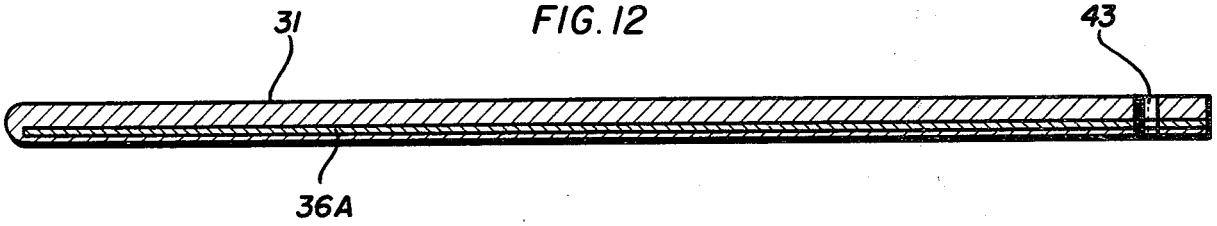

The embodiment of FIG. 12 shows an elastomeric composite strip like that shown in FIGS. 1 to 4 but with the stiffeners 36A positioned closer to one face than the other face of the strip.

Figure 13:
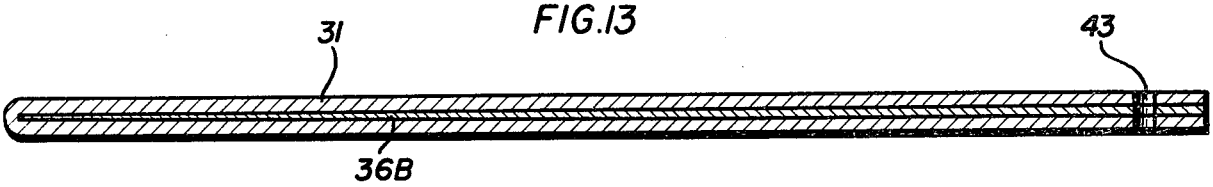

FIG. 13 shows an elastomeric composite strip in which the stiffeners 36B are tapered with the thick end being adjacent bolt holes 43 and the thin end adjacent the end of the strip which is to contact the tank wall inner surface. This type of structure provides an additional approach for achieving a desired sealing pressure and arc on the strip when put in place on a floating roof.

The foregoing detailed description has been given for clearness of understanding only, and no unnecessary limitations should be understood therefrom as modifications will be obvious to those skilled in the art.

What is claimed is:

1. In a vertical cylindrical liquid storage tank of imprecise circularity having a circular floating roof of smaller diameter than the tank thereby defining a vapor space between the roof edge and the tank wall, an improved sealing means for substantially preventing flow of vapor from a liquid product stored in the tank through the vapor space to the atmosphere, said sealing means including:

an elastomeric composite strip impermeable to vapor connected at its inner edge by an essentially vapor tight joint to the roof edge and extending as an annulus outwardly to the tank inner side wall, the elastomeric composite strip comprising a plurality of flexible resilient elongated stiffeners laterally positioned and embedded in elastomeric material, the elongated stiffeners extending from the strip edge joined to the roof and terminating short of the strip edge at the tank wall, and said elastomeric strip flexing in a vertical arc as the roof moves toward and away from any adjoining tank wall portion, with circumferential stretching and contraction of the strip at its outside periphery unrestrained by the stiffeners thereby permitting the strip to very readily and efficiently contact and accommodate to the contour and spacing of the tank wall from the roof edge to maintain sealing contact with the tank wall above the vapor space as the roof moves laterally and vertically and thus keep vapor from escaping.

2. An improved sealing means according to claim 1 in which about at least the outer two-thirds of said stiffeners have portions spaced-apart from adjoining stiffeners.

3. An improved sealing means according to claim 1 in which the elongated stiffeners are flat fingers.

4. An improved sealing means according to claim 3 in which the fingers are tapered in width and narrower at the tank wall than at the roof edge.

5. An improved sealing means according to claim 1 in which the elongated stiffeners include flat fingers tapered in width projecting laterally from a band portion along the strip edge at the roof edge.

6. An improved sealing means according to claim 3 in which the elongated stiffeners are made of polymeric material or of spring metal.

7. An improved sealing means according to claim 1 in which a fabric or plurality of cords is embedded in the elastomeric material either on the top or bottom side or both sides of the stiffeners.

8. An improved sealing means according to claim 1 in which the stiffeners vary in thickness and are thinner at the tank wall than at the edge joined to the roof.

9. An improved sealing means according to claim 1 in which the strip is of varying thickness and is thicker at the roof edge than at the edge in contact with the tank wall.

10. An improved sealing means according to claim 1 in which the strip is preformed to have an arced portion or is bent to have an inclined portion.

11. In a vertical cylindrical liquid storage tank of imprecise circularity having a circular floating roof of smaller diameter than the tank thereby defining a vapor space between the roof edge and the tank wall, an improved sealing means for substantially preventing flow of vapor from a liquid product stored in the tank through the vapor space to the atmosphere, said sealing means including:

an elongated elastomeric composite strip, with parallel inner and outer edges, impermeable to vapor connected at its inner edge by an essentially vapor tight joint to the roof edge and extending as an annulus outwardly into contact with the tank inner side wall, said strip having uniformly smooth surfaces on both sides adjacent the outer edge, the elastomeric composite strip comprising a plurality of flexible resilient elongated stiffeners laterally positioned and embedded in elastomeric material, the elongated stiffeners extending from the strip edge joined to the roof and terminating short of the outer strip edge at the tank wall, and said elastomeric strip flexing in a vertical arc as the roof moves toward and away from any adjoining tank wall portion, with circumferential stretching and contraction of the strip at its outside periphery unrestrained by the stiffeners thereby permitting the strip to very readily and efficiently contact and accommodate to the contour and spacing of the tank wall from the roof edge to maintain sealing contact with the tank wall above the vapor space as the roof moves laterally and vertically and thus keep vapor from escaping.

* * * * *